United States Patent [19]

Verive

[11] 3,989,403

[45] Nov. 2, 1976

[54] APPARATUS FOR SPREADING PAVEMENT SEALANT

[75] Inventor: Alphonse Verive, Harrison, Ark.

[73] Assignee: BASF Aktiengesellschaft, Ludwigshafen, Germany

[22] Filed: June 6, 1975

[21] Appl. No.: 584,461

[52] U.S. Cl. ..... 404/111; 222/177

[51] Int. Cl.[2] ..... E01C 19/18

[58] Field of Search ..... 404/111, 110, 108; 239/159, 146; 222/177; 401/48

[56] References Cited

UNITED STATES PATENTS

| | | | |
|---|---|---|---|
| 791,726 | 6/1905 | Schutte | 404/118 X |
| 958,434 | 5/1910 | Price | 404/111 |
| 1,419,537 | 6/1922 | Bellar | 404/110 |
| 1,641,703 | 9/1927 | Stanton | 404/110 |
| 1,712,549 | 5/1929 | Castellano | 404/110 |
| 1,811,324 | 6/1931 | Lockard | 404/110 X |
| 1,940,898 | 12/1933 | Arndt | 404/110 |
| 3,183,803 | 5/1965 | Gierhart | 404/111 |
| 3,283,675 | 11/1966 | Gifford | 404/111 |

*Primary Examiner*—Nile C. Byers, Jr.
*Attorney, Agent, or Firm*—Johnston, Keil, Thompson & Shurtleff

[57] ABSTRACT

An apparatus for spreading viscous pavement sealant which comprises a means for carrying a quantity of the sealant, the carrying means having means for discharging a flow of the sealant onto the surface and means for controlling the rate of sealant flow. Further included are means pivotally mounted on the carrying means and resiliently biased against the surface for spreading a layer of the discharged sealant over the surface, and means pivotally mounted on the carrying means and resiliently biased against the surface for brushing the layer of sealant evenly over the surface. Means are provided for limiting the travel distance of the spreading and brushing means toward the surface. In one preferred embodiment, the apparatus is mounted on wheels and the discharging means include an auger driven by the wheels.

8 Claims, 8 Drawing Figures

APPARATUS FOR SPREADING PAVEMENT SEALANT

BACKGROUND OF THE INVENTION

1. Field of the Invention

The present invention relates to the art of spreading sealant onto a paved surface, such as a blacktop driveway.

2. The Prior Art

A variety of machines have in the past been proposed for the spreading of materials for sealing or otherwise improving the surface quality of pavement. For example, U.S. Pat. No. 791,726 discloses an apparatus for spreading bitumen and the like. This apparatus consists primarily of a tank with a central opening at the lower portion for dispensing the bituminous material, and having a curved, flexible spreader located beneath the tank. Wheels are mounted behind the tank for easy transportation of the apparatus when not in use. This design has a number of serious drawbacks. First, the bitumen is dispensed from the tank only in the central area. This, of course, will cause uneven distribution of the material across the width of the spreader's path since none of the materials is dispensed at the outboard regions of each swath. A second disadvantage is that the curved spreader will tend to further concentrate the material on the pavement in the center of each swath as the operator pulls the apparatus along. Third, the device is difficult to pull along since it rests on the wheels only when not in use. Fourth, the apparatus has no adjustable stop or other means for limiting the flow rate to a predetermined amount on successive passes over the surface. Each time the valve is closed, the operator must estimate the proper valve position upon reopening. In addition to the above, this design provides only for a squeegee effect which levels off the material deposited on the surface to be coated, without providing a means for forcing the coating material into the gaps and pores of the surface.

U.S. Pat. No. 1,419,537 embodies features which represent some improvement over prior designs, such as the addition of a rigidly mounted brush and of wheels which support the weight of the tank. However, there are disadvantages to this design as well. For example, the brush and wiper members are rigidly mounted on the tank and do not independently ride up and down to provide for even spreading over uneven surfaces. The wheels are arranged so that, when not in use, the operator must lift the majority of the device's weight to transport it without having the brush and wiper dragging over the surface. The arrangement also requires the operator to push, rather than pull the device; this means he must necessarily walk on the viscous material just deposited. Furthermore, the valve system is located so high in the flow path that the operator must anticipate the amount of material flowing onto the surface after the valve is closed. Failure to accurately estimate this amount will cause too much or too little coating to be deposited at the end of a swath.

U.S. Pat. No. 821,152 discloses an oil sprinkling device which, while dispensing oil across the width of a swath, provides no means for brushing the material into the surface or scraping it off level with the surface. In addition, having the valves so far from the sprinkler causes a good deal of the oil to be wasted when the flow is shut off at the end of a swath.

To concrete distributing cart described in U.S. Pat. 1,641,703 has several of the disadvantages noted above, the major one of which is that no means for brushing the material into the interstices of the surface to be filled is provided.

The Stone Spreader of U.S. Pat. No. 1,811,324 employs an auger device for distribution of the material, but is not adapted for spreading a wide path of viscous material.

SUMMARY OF THE INVENTION

The present invention provides a spreading device which overcomes the many disadvantages of the prior art devices. A carrying tank, mounted on wheels for easy transportation, has apertures for discharging a flow of viscous pavement sealant. A valve is provided at or near the discharge point for controlling the rate of flow of the sealant; the valve is fitted with an adjustable stop so that once closed, the valve may be easily reopened to its previous position. A flexible spreader is resiliently biased against the surface to evenly distribute the sealant, and a similarly biased brush follows the spreader to force the sealant into the surface. Resilient biasing of the spreader and brush has the added advantage that since any wear of these components is automatically compensated, no manual readjustment is necessary.

The apparatus is designed to handle sealants having a wide range of viscosities and to spread such sealants evenly over a given surface at a predetermined thickness with a minimum of waste. It also provides means for achieving optimum bonding to rough and uneven surfaces.

Further advantages will be apparent to those skilled in the art from the following detailed description of the invention.

DETAILED DESCRIPTION OF THE PREFERRED EMBODIMENTS

Figure 1:
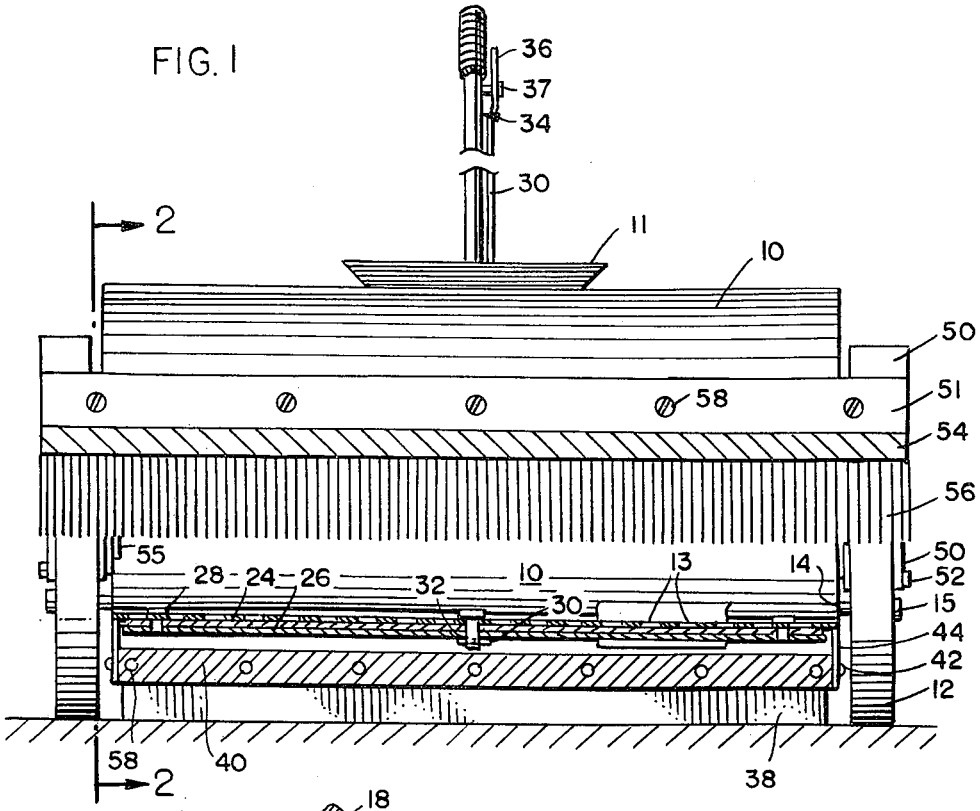
FIG. 1 illustrates a front view of a first preferred embodiment of the sealant spreader with a portion of the carrying tank shown cut away and the brush in raised position.

FIG. 1 illustrates a first preferred embodiment of the sealant spreader. A cylindrical sealant carrying tank 10 having a lipped filler opening 11 has a pair of rigidly attached axles 14, upon which are rotatably mounted wheels 12; the wheels are retained on the axles by means of end caps 15. The tank is fabricated from suitable sheet metal with all seams welded to be watertight. It is preferably of 5½ to 6 gallon capacity so that an entire 5-gallon pail of emulsion sealant mixed with sand and/or water will be contained. The wheels may be of any suitable type, preferably having solid rubber tires and being of about 6-inch diameter. A handle 16 for pulling the spreader is removably attached to the tank by a bolt 17. The handle is preferably constructed of two sections of thin-walled metal tubing which bolt together at point 5, and is bent upwardly so that the upper end is at the operator's waist level. At the upper end of the handle is a grip 18 for permitting the operator to get a firm grasp on the device. The grip is preferably of molded vinyl, with a ribbed outer surface. A kickstand 20 is rotatably attached to the lower portion of the handle at 21 and can be positioned to support the spreader when not in use or rotated upwardly to clear the ground when the spreader is being used. The kickstand is mounted frictionally so that it can be easily positioned, but will not rotate without manual aid.

A row of apertures 13 is located at the lowest point of tank 10 when the tank is in opening position. The apertures may be ½ inch diameter circular holes, as shown, or may be ½ inch by 8 inch slots. The slots have been found to provide trouble-free discharge when the emulsion is mixed with sand. The apertures are spaced apart, about 1 inch center to center in the case of circular holes, and are shown in the cutaway portion of FIG. 1. These apertures are covered by a stiff, metal flap 26. The flap is pivotally attached to tank 10 by hinges 28, and is lined with a seal 24 of neoprene or similar material. The outer sheath of any conventional control cable 30 is fastened to handle 16 at brackets 34, while the lower end of the cable itself is rotatably attached to an arm 32 on flap 26. A lever 36 is pivoted on a bracket 37 welded to handle 16 and fastened to the upper cable end so that the operator may easily open and close flap 26 by rotating the lever. Bracket 34 nearest to grip 18 has an adjustable screw member 35 which limits the forward travel of lever 36. By setting the screw member to a given position, the operator can preset the maximum flow rate of sealant.

Beneath tank 10 a means is provided for evenly spreading a layer of the sealant after it has been discharged. The spreader consists of a frame member 40 pivoted at points 42 on brackets 44 and having a flexible scraper 38 attached with screws 58. Brackets 44 and frame member 40 are fabricated from sheet steel of suitable thickness. The scraper can be of any flexible material, such as neoprene, and preferably has end portions about 3 –7 inches in length bent rearwardly to provide side walls. These side walls prevent excess sealant from escaping around the ends of the spreader. The frame member also has rearwardly bent side walls which extend beyond pivot point 42. At the end of each frame member side wall is a stop 41 which is positioned to limit the rotational travel of scraper 30 by contacting the bottom of tank 10. The scraper is resiliently biased against the surface to be coated by springs 46, each of which pulls a frame member side wall end toward a tank-mounted lug 48.

In addition to the spreader, a brush is provided for working the sealant into the surface and smoothing the layer of sealant. The brush consists of a block 54 of wood or other suitable material, having bristles 56. The bristles extend approximately 2 inches from the block and are of nylon or a similar material. The brush is mounted with screws 58 on a metal bar 51, which is in turn welded to a pair of curved arms 50. Arms 50 are pivotally attached to the lower rear portion of the tank ends at pivots 52. These arms serve not only as a fulcrum for the vertical motion of the brush, but act also as fenders which prevent excess sealant on wheels 12 from spraying onto the operator. Note that in FIG. 1 the brush is shown in raised position so as to reveal the construction of the spreader and flap, while in FIG. 2 the brush is lowered to operating position. A spring 53 resiliently biases each arm 50 to a lug 55 on tank 10. This causes brush 56 to press firmly against and to follow the contour of the surface to be coated. A stop 59 is attached to each end of tank 10 to limit the downward travel of the brush.

Figure 2:
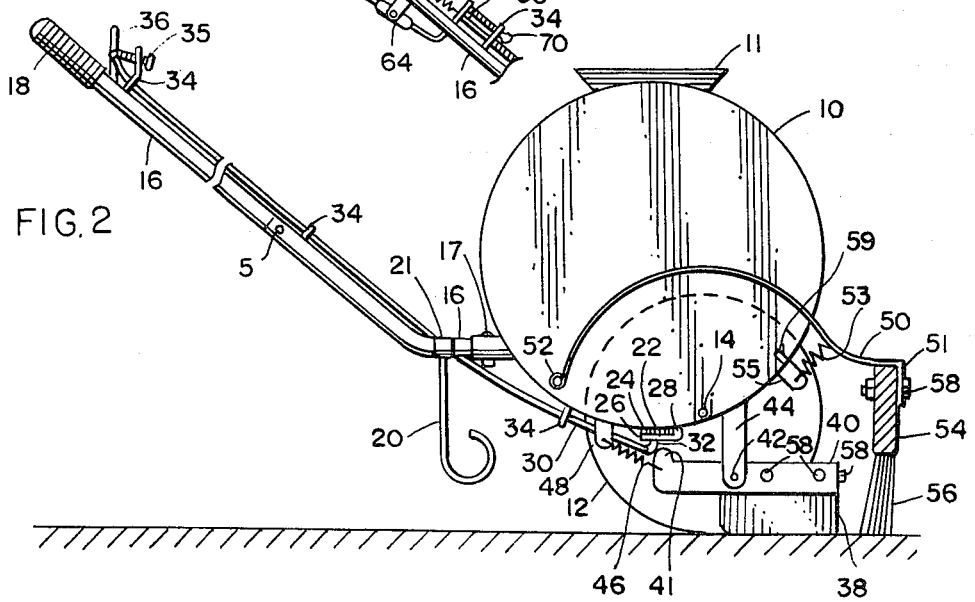
FIG. 2 is a side view of the embodiment of FIG. 1 taken along line 2 —2, but with the brush lowered.

In operation, the tank of the apparatus shown in FIGS. 1 and 2 is filled with any viscous pavement sealant through lipped filler opening 11, preferably with flap 26 in the closed position. By lowering the handle 16 until the spreader and brush hit their respective stops 41,59, the operator can maneuver the device on wheels 12 to a desired starting location. When the starting location (such as one corner of an asphalt driveway) is reached, the operator sets adjustable screw member 35 to the desired flow rate. He then rotates lever 36 to open flap 26 and begin the discharge of sealant, raises the handle, and pulls the device along at a steady rate. As sealant flows onto the surface, it is distributed evenly by scraper 38 and brushed into the contours of the surface by bristles 56. Minor surface contours in the direction of travel are tracked by the resiliently biased scraper and brush. Large cracks, crevices and valleys, which are deeper than the stops 41, 59 will permit the scraper and brush to follow, will be at least partially filled in by excess sealant. Variations in the surface along the longitudinal axes of the spreader and brush will ordinarily be compensated by flexing of the scraper and the brush bristles.

Figure 3:
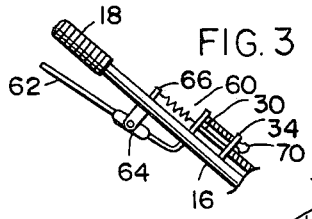
FIG. 3 shows an alternative embodiment of the valve control lever assembly.

FIG. 3 shows an alternative embodiment of the handle-mounted lever assembly. It is particularly desirable to have a means of controlling the flow continuously whereby the operator needs only one hand to operate the device. In this configuration, a lever 62 is pivotally mounted on a member 64 which is welded to the handle. The lever is attached to cable 30 so that when grip 18 and lever 62 are squeezed together by the operator, flap 26 is opened. The lever is biased toward lug 66 by spring 68 so that when the lever is released, flap 26 will automatically close. An adjustable screw member 70 may be preset to limit the maximum amount of sealant flow.

Figure 4:
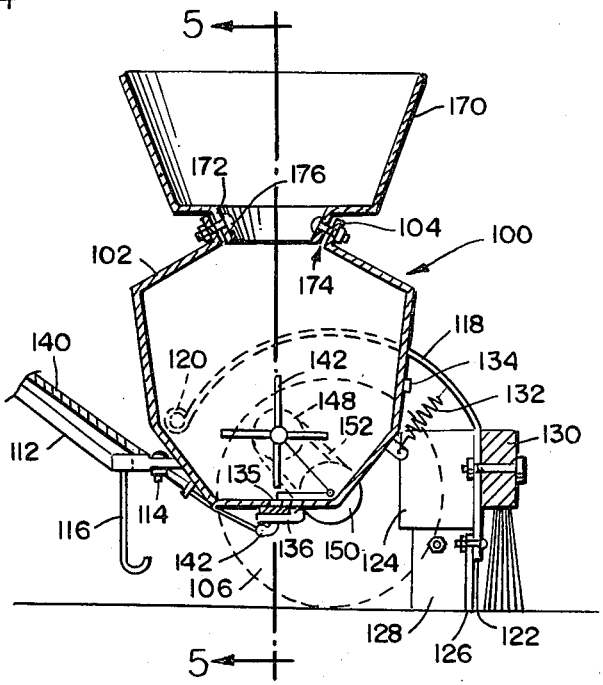
FIG. 4 is a sectional view of an alternative sealant spreader configuration, taken along line 4 —4 of FIG. 5.
Figure 5:
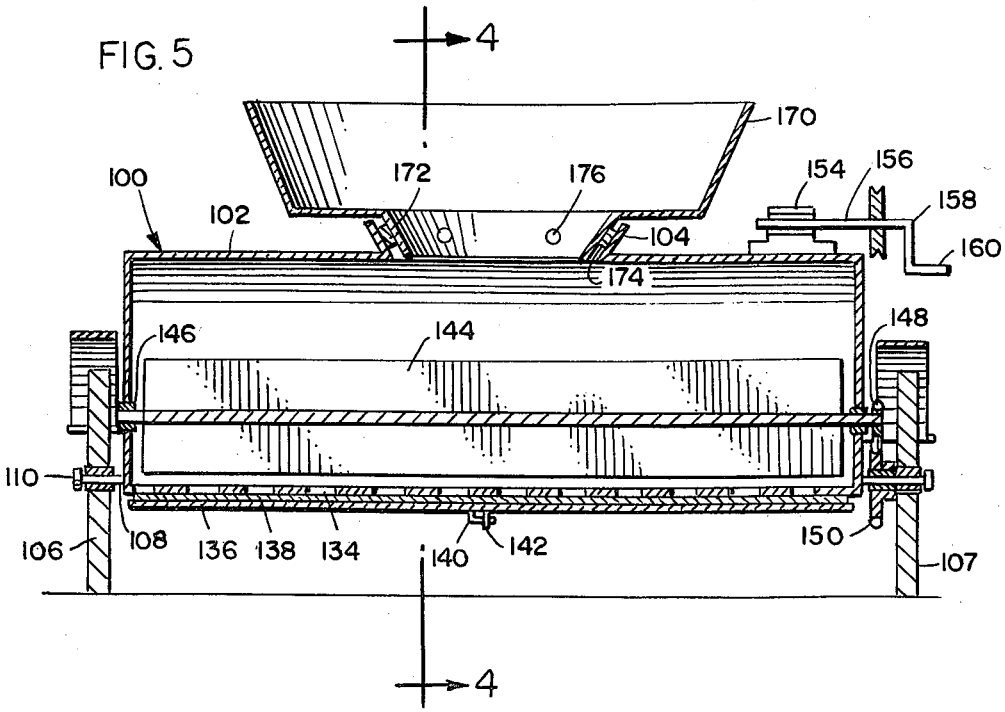
FIG. 5 is a sectional view of the configuration of FIG. 4 taken along line 5 —5.

FIGS. 4 and 5 show a second preferred configuration of the sealant spreader generally at 100. In this form the carrying tank 102 is approximately hexagonal in cross-section and has a lipped filler opening 104 at the top surface. Wheels 106, 107 are mounted for free rotation on axles 108 and held in place by end caps 110. The axles are rigidly attached to the ends of the carrying tank. A handle 112 is removably attached to the tank by bolt 114, and has a movable kickstand 116 for supporting the apparatus when not in use. An arm 118 is pivotally attached to the lower rear portion of each tank end at 120. The arms are welded to a frame member 22 which extends across the front of the tank and which has rearwardly bent side wall portions 124. A scraper 126 of neoprene or other suitable material is fastened to the lower edge of the frame member and also has rearwardly bent side portions 128. Brush 130 extends across the width of the tank and is fastened to the front surface of frame member 122 as shown. Each arm 118 is resiliently biased by a spring 132 in a downward direction, a stop 134 being provided on the tank to limit the downward travel of the arms. One or more apertures 135 is provided in the bottom of the tank for discharge of the sealant. A trap 136 of metal or other rigid material is hinged to the tank and lined with a flexible seal 138 for covering the discharge apertures. Cable 140 is pivotally attached to the flap by arm 142 so that movement of the cable will effectuate operation of the flap. A grip and handle-mounted lever assembly such as that shown in FIG. 3 is provided for convenient manual operation of the flap.

The configuration of FIGS. 4 and 5 further includes an agitator 144 positioned inside the tank and mounted in bushings 146 for rotational movement. The agitator is preferably of paddle-wheel type design, but may be an auger as will be described below with regard to FIGS. 6 and 7. Agitator 144 comprises a series of paddle blades fastened to a shaft which is supported by bushings 146 in the ends of the tank. One end of the agitator shaft is fitted with a pulley 148. A pulley 150 is also mounted on the adjacent wheel 107 for rotational motion with the wheel. A pulley belt 152 connects pulleys 148, 150 so that when the apparatus is pulled along by an operator, rotational movement of the wheel 107 is transmitted to the agitator. In this manner, the sealant is continuously mixed so that heavier particles, such as sand added to the sealant, do not settle to the bottom. This prevents uneven distribution of the sealant and possible clogging of the discharge apertures. A pillow block 154 is mounted on top of the tank, having a shaft 156 mounted for rotation. The shaft is bent to form a handle 160 and is equipped with a pulley 158. If the operator desires to use the agitator for mixing sand or water thoroughly with the emulsion sealant before spreading over a pavement surface, the pulley belt is changed to connect pulleys 148, 168 and the handle 160 is cranked.

In the preferred embodiment of FIGS. 4 and 5 the lipped filler opening 104 of carrying tank 102 is adapted to receive a holding tank 170. A male member 172 around an opening in the bottom of the holding tank fits snugly into the lipped filler opening 104 of the carrying tank. Seal 174 between the male member and the lipped filler opening prevents leakage of sealant around the joint, while bolts 176 serve to retain the holding tank securely in place. Addition of the holding tank to the apparatus permits a larger quantity of sealant to be carried; this is a desirable feature when coating very large areas, such as parking lots, with sealant.

Figure 6:
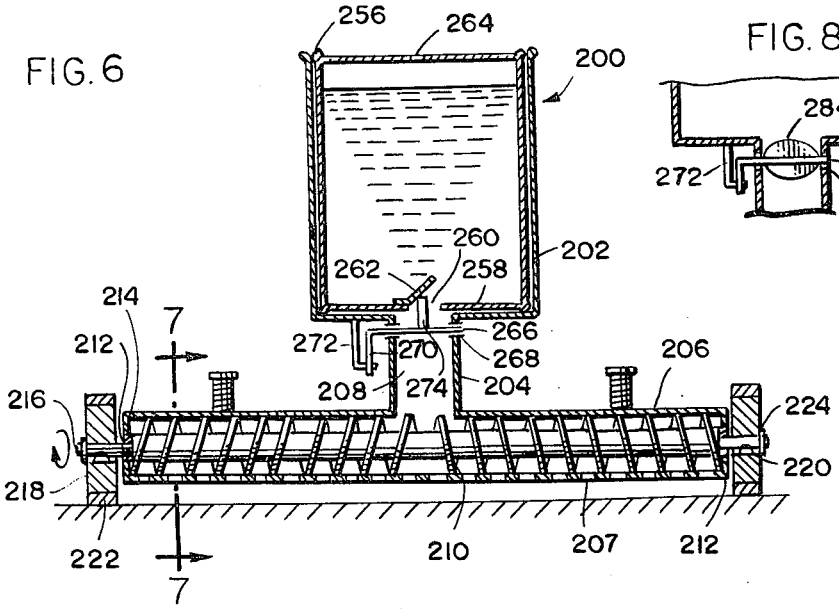
FIG. 6 is a sectional view of another embodiment of the sealant spreader taken along line 6—6 of FIG. 7.
Figure 7:
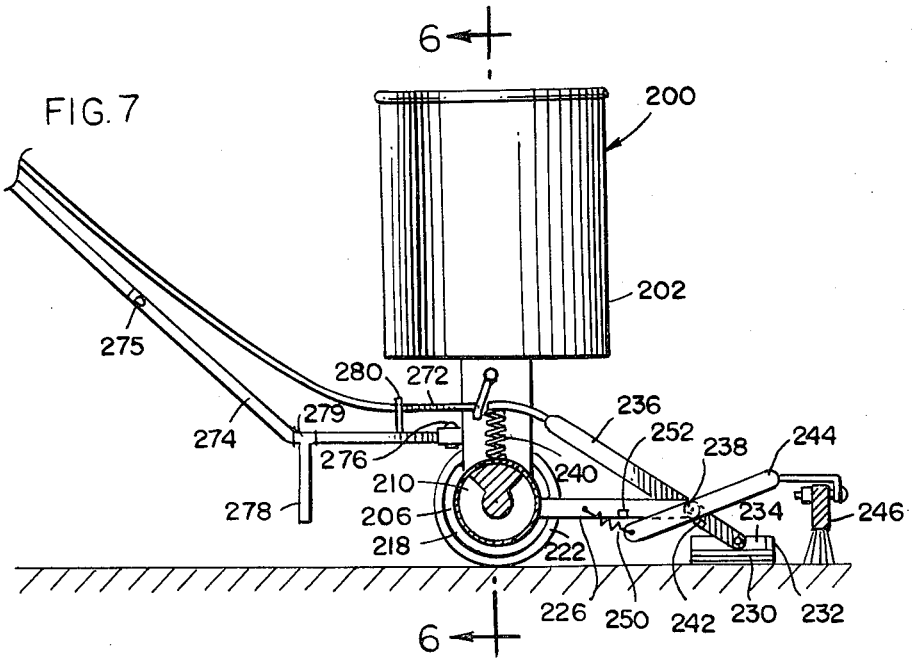
FIG. 7 is a sectional view of the embodiment of FIG. 6 taken along line 7—7.

A further advantageous embodiment of the invention is shown generally at 200 in FIGS. 6 and 7. A cylindrical sealant carrying tank 202 is welded to a smaller-diameter vertical section of tubing 204 which is in turn welded to a horizontally positioned cylinder 206. Discharge apertures 207 provided in the lower wall portion of cylinder 206 may be ½ inch diameter circular holes or ½ inch wide slots. The inside diameter of the thin-walled tube and cylinder is about 4 inches. A passageway 208 is provided for sealant flow from tank 202 through tube 204 to cylinder 206. An auger 210 is positioned in cylinder 206 and rotatably mounted on bushings 212 set in cylinder ends 214. The auger is only slightly smaller in diameter than the cylinder. A shaft 216 extends from each end of the auger and through the respective cylinder end 214 to support a wheel 218. Each wheel is fixedly secured on a shaft 216 by means of a key 220 and an end cap 224. The wheels preferably have resilient tires 222 of rubber or a similar material. The auger is turned by the rotation of the wheels as the apparatus is pulled by an operator.

A pair of supports 226 are welded securely to the front of cylinder 206 for supporting the spreader and brush assemblies. Scraper 230 is fixed to a frame member 232 and both scraper and frame member have a rearwardly bent side wall portion at each end. Two small brackets 234 are welded to frame member 232; each of these brackets is pivotally mounted on the forward end of a rotating arm 236 which is in turn pivotally mounted on a support 226 at 238. The rearward end of each arm 236 is resiliently biased upwardly by a compression spring 240 the lower end of which is supported by cylinder 206. By forcing the rearward end of arms 236 up, springs 240 cause scraper 230 to be resiliently biased against the surface to be coated. Pivotal mounting of frame member 232 on arms 236 allows the scraper to maintain a proper angle with the surface. Stops 242 are positioned to limit the rotational travel of arms 236 with respect to supports 226. A second pair of rotating arms 244 is provided, each being pivotally mounted at point 238 of a support 226. The forward end of each arm 244 is bolted to a brush 246 of the type described with reference to FIGS. 1 and 2, while the rearwardly extending end of each arm 244 is biased toward support 226 by a spring 250. Each support 222 has a small protruding stop 252 which limits the travel of a respective arm 244.

Carrying tank 202 is preferably dimensioned to hold a conventional 5-gallon bucket 256 of the type in which emulsion sealant is commonly marketed. The bucket lid is replaced with a similar lid 258 which has a central opening 260 of slightly smaller diameter than tube 204 and which has a flexible seal 262 fastened to the inside surface thereof over opening 260. The flap is constructed of rubber, neoprene, or similar material, and is cemented along one quadrant of the pail lid opening. When the pail and lid 258 assembly is inverted as shown, the flap prevents any substantial leakage of sealant from the pail. To fill the containing tank for use, the operator replaces the pail lid with the modified lid 258, inverts the pail and drops it into tank 200. He then punches one or more air vent holes 264 in the pail bottom.

A rod 266 is rotatably mounted in bushings 268 across the diameter of tube 204 about 1 inch below the tank bottom. The rod has a downwardly bent portion 270 which attaches to a control cable 272 outside of tube 204. A rigid lever arm 274 extends from the rod inside the tube so that when the rod is rotated, it will push upwardly on the seal to permit sealant to flow into the tube. Handle 274 is constructed of two thin-walled tubing sections bolted together at 275 and removably attached to a bracket on tube 204 by means of a bolt 276. The handle has a rotatably mounted kickstand similar to that described above with reference to FIG. 2, which serves to support the apparatus when not in use. The outer sheath of control cable 272 is affixed to the handle by one or more brackets 280. The upper end of handle 274 is equipped with a hand grip and control lever assembly such as described above with reference to FIG. 3. Operation of the apparatus shown in FIGS. 6 and 7 is the same as that outlined with reference to FIGS. 1 and 2.

Figure 8:
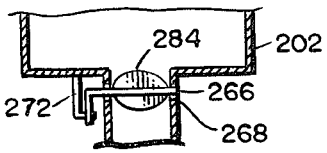
FIG. 8 shows an alternative flow control valve for the embodiment of FIGS. 6 and 7.

FIG. 8 illustrates an alternative flow control valve for the device shown in FIGS. 6 and 7. Rod 266 carries a circular disc of metal or other rigid material which can be rotated to open or close tube 204 to a flow of sealant. With this type of valve, the tank is filled by pouring the sealant from the pail directly into the tank. Any type of sealant may be used in the sealant spreaders described above, although a water-base tar emulsion type sealant is preferable due to the ease with which this type of sealant can be cleaned from the spreader after use.

It is to be understood that many modifications may be made within the spirit and scope of the invention described herein. The invention is not limited to these specific embodiments, but is instead defined by the following claims.

I claim:

1. Apparatus for spreading pavement sealant on a surface, comprising:

a. means for carrying a quantity of said sealant, said carrying means having;

1. means for discharging a flow of said sealant onto said surface, including at least one aperture in said carrying means;

2. means for controlling the rate of flow of said sealant, including a manually actuatable flopper valve; and 3. means rotatably mounted for wheeling said apparatus;

b. flexible means pivotally mounted on said carrying means and resiliently biased against said surface for spreading a layer of said discharged sealant over said surface;

c. means pivotally mounted on said carrying means and resiliently biased against said surface for brushing said layer of sealant evenly over said surface;

d. means for limiting the travel distance of said spreader means toward said surface;

e. means for limiting the travel distance of said brush means toward said surface; and f. rigid handle means connected for allowing manual pulling of said apparatus along said surface, whereby when said handle is in a first vertical position said spreader means and said brush means are resiliently biased against said surface for spreading sealant, and when said handle is in a second vertical position said spreader means and said brush means are held away from said surface by the respective said brushing means so that said apparatus may be freely wheeled about when not being used for spreading sealant.

2. The apparatus of claim 1, wherein said discharging means comprises an auger.

3. The apparatus of claim 1, wherein said discharging means comprises an auger driven by rotation of said wheel means.

4. The apparatus of claim 1, further comprising means for agitating said pavement sealant.

5. The apparatus of claim 4, wherein said agitating means comprises a rotating paddle wheel positioned inside said carrying means.

6. The apparatus of claim 1, further comprising a pail for holding an additional quantity of said sealant, said pail being provided with a lid having a central opening, said opening being covered by said flopper valve, and wherein said carrying means includes means for receiving said pail and lid whereby said apparatus may be filled with said sealant by installing said lid on said pail of sealant, inverting said pail and lid and inserting said inverted pail in said carrying means.

7. The apparatus of claim 1, wherein said brush means is pivotally mounted on said carrying means by a pair of curved pivot arms, said curved pivot arms extending at least partially around said wheel means, whereby said pivot arms form shields which block the spray of any sealant from said wheel means when said wheel means are rotated.

8. The apparatus of claim 1, further including an adjustable stop for limiting the travel of said manually actuatable flopper valve.

* * * * *

UNITED STATES PATENT AND TRADEMARK OFFICE

CERTIFICATE OF CORRECTION

PATENT NO. : 3,989,403

DATED : November 2, 1976

INVENTOR(S) : Alphonse Verive

It is certified that error appears in the above-identified patent and that said Letters Patent are hereby corrected as shown below:

In the Heading, delete " Assignee: BASF Aktiengesellschaft, " Ludwigshafen, Germany In Column 2, Line 1, delete " To concrete distributing ... " and substitute -- The concrete distributing ... --

In Column 6, Line 5, delete " Scraper 230 is fixed ... " and substitute -- Scraper 230 is affixed ... --

Signed and Sealed this

Twenty-ninth Day of March 1977

[SEAL]

*Attest:*

RUTH C. MASON
*Attesting Officer*

C. MARSHALL DANN
*Commissioner of Patents and Trademarks*